United States Patent [19]

Schluckebier

[11] Patent Number: 4,955,528

[45] Date of Patent: Sep. 11, 1990

[54] CONTAINER FOR FOOD AND CONDIMENTS

[76] Inventor: Patricia A. Schluckebier, 88496 Partridge La., Springfield, Oreg. 97478

[21] Appl. No.: 334,893

[22] Filed: Apr. 7, 1989

[51] Int. Cl.[5] ..... B65D 5/48

[52] U.S. Cl. ..... 229/120.18; 229/1.5 B; 229/902; 493/56; 493/121; 493/162

[58] Field of Search ..... 229/1.5 B, 16 A, 120.08, 229/120.17, 120.18, 902, 906; 493/56, 68, 79, 121, 162

[56] References Cited

U.S. PATENT DOCUMENTS

| | | | |
|---|---|---|---|
| 2,794,585 | 6/1957 | Wagner | 229/120.18 |
| 2,924,372 | 2/1967 | Kirkeby | 229/904 |
| 3,442,435 | 5/1969 | Ludder et al. | 229/904 |
| 3,468,317 | 9/1969 | Rowland | 131/235 |
| 3,561,664 | 2/1971 | Palmer | 229/1.5 B |
| 3,567,105 | 3/1971 | McFarlin | 229/904 |
| 4,126,261 | 11/1978 | Cook | 229/120.08 |
| 4,218,008 | 8/1980 | Veilleux | 229/904 |
| 4,489,878 | 12/1984 | Mode | 229/120.17 |
| 4,711,389 | 12/1987 | Alba et al. | 229/1.5 B |
| 4,714,190 | 12/1987 | Morrocco | 229/1.5 B |
| 4,718,595 | 1/1988 | Jones | 229/1.5 B |

FOREIGN PATENT DOCUMENTS 614289 5/1935 Fed. Rep. of Germany .

*Primary Examiner*—Gary Elkins

*Attorney, Agent, or Firm*—Klarquist, Sparkman, Campbell, Leigh & Whinston

[57] ABSTRACT

A paperboard container for food and condiments is disclosed. The container is formed from a one piece blank cut from rectangular paperboard stock. The finished container has a first receptacle and an adjacent second fluid tight receptacle for condiments. The fininshed container may be collapsed to a flat condition for storage and may be stacked one upon another in the open position.

4 Claims, 2 Drawing Sheets

CONTAINER FOR FOOD AND CONDIMENTS

TECHNICAL FIELD

This invention relates to paperboard food containers. Specifically, a paperboard container for food and condiments is disclosed, along with the blank from which the container is formed and the process to manufacture the container.

BACKGROUND ART

Paperboard food containers are well known and have been manufactured in a variety of configurations for specific food products. Containers such as described herein have a wide popularity in restaurants, particularly "fast" food restaurants for dispensing and containing food such as french fried potatoes, meat, fish and poultry products.

Certain characteristics of these containers have become functional beyond merely holding the food products. The container must be collapsible and fold flat for shipping. The container when partially or fully open must be able to be stacked and nested, one within another. The container when opened must be capable of being used as a scoop to pick up the food product.

Many of the food products such as french fried potatoes or fish are eaten with condiments such as catsup or tartar sauce. Up until now, however, no food container has been produced to simultaneously hold the food product and a condiment.

BRIEF SUMMARY OF THE INVENTION

It is a broad object of the present invention to produce a food container having an internal compartment for condiments which can be manufactured from a one piece blank cut from rectangular paperboard stock.

It is a further object of the invention to provide a paperboard food container having a major container receptacle for receiving food products and a minor container receptacle, adjacent to the major container receptacle for receiving condiments and the like.

It is another object of the invention to produce a food container that can stack, one inside another when the container is partially or fully open.

Another object of the invention is to provide a food container that when open can act as a scoop to pick up the food product.

The present invention accomplishes these objects and others, as will be apparent below, by cutting a one piece blank from a rectangular piece of paperboard stock. The blank includes a first member which has a central portion. Two flaps are hinged, one on each side of the central portion of the first member. The bottom of the central portion of the first member is hinged to a second member. The second member is also hinged to a central portion of a third member. The third member has two flaps, one hinged to each side of the central portion of the third member. The flaps hinged to the third member each have two fold lines running substantially parallel to the hinge line of the central portion creating three segments. The third or outermost segment of each flap has a glue surface over its face.

The container is formed by folding the first flap of the first member behind the central portion of the first member. This first flap is glued to the bottom of the central portion of the first member along the bottom of the first member. The second flap of the first member is folded behind the central portion of the first member and the bottom of the second flap is glued to the bottom of the central portion of the first member. The second flap partially overlaps the first flap and is glued to the first flap where the second flap overlaps the first flap. The space between the central portion of the first member and the combination of the first flap and the second flap forms a fluid tight container receptacle for condiments.

The second member, in addition to the hinge line connecting the central portion of the first member and the hinge line connecting the central portion of the third member, also has a fold line bisecting the second member and lying parallel to the two hinge lines. The second member is folded along the hinge lines and the central fold line such that the central portion of the third member overlaps and lies upon the central portion of the first member.

The first flap of the third member is folded along its respective fold lines such that the outermost or third segment lies behind and partially overlaps the first flap of the first member. The first flap of the third member is glued to the first flap of the first member where the flaps overlap. The second flap of the third member is folded in a similar manner such that the outermost or third segment partially overlaps the second flap of the first member. The second flap of the third member is glued to the second flap of the first member where they overlap. The space between the central portion of the third member and the central portion of the first member forms an open receptacle container for receiving food products.

BEST MODE OF CARRYING OUT THE INVENTION

Figure 1:
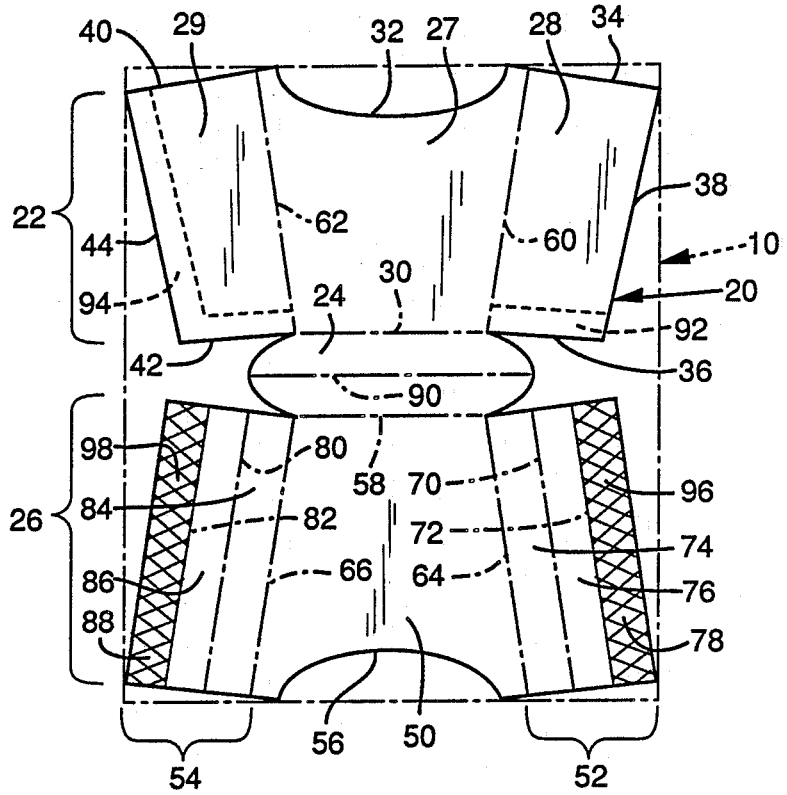
FIG. 1 is plan view of the blank used to form a container constructed in accordance with the invention.

Referring to FIG. 1, rectangular paperboard stock 10 is shown in dashed lines. The one piece blank 20 from which a container of the invention is constructed is shown in solid lines within rectangular paperboard stock 10. Blank 20 has three major components, a first member 22, a second member 24 and a third member 26. First member 22 has a central portion 27, a first flap 28 and a second flap 29. Central portion 27 of first member 22 is hinged along its bottom along first fold line 30. The top of central portion 27 has a recessed cutout 32. The first flap 28 has a top 34, a bottom 36 and an outside edge 38. The second flap 29 has a top 40, a bottom 42 and an outside edge 44.

The third member 26 has a central portion 50, a first flap 52 and a second flap 54. Central portion 50 of third member 26 has a cutout 56 along its top. The bottom of central portion 50 of third member 26 is hinged to second member 24 along second fold line 58.

The first back wall flap 28 is hinged to the central portion 27 of back wall 22 along third fold line 60. Third fold line 60 intersects first fold line 30. Second flap 29 of first member 22 is hinged to the central portion 27 of first member 22 along fourth fold line 62. In the illustrated embodiment, the fourth fold line 62 intersects the first fold line 30. Third fold line 60 and fourth fold line 62 are slightly divergent such that the top of central portion 27 is wider than the bottom of central portion 27.

Central portion 50 of third member 26 is hinged to first flap 52 of third member 26 along fifth fold line 64. Fifth fold line 64 intersects second fold line 58. Second flap 54 of third member 26 is hinged to central portion 50 of third member 26 along sixth fold line 66. Sixth fold line 66 intersects second fold line 58. Fifth fold line 64 and sixth fold line 66 are slightly divergent such that the top of central portion 50 is wider than the bottom of central portion 50. It should be noted that in an alternate embodiment, hinge line 30 may be foreshortened and the third fold line 60 and fourth fold line 62 need not intersect fold line 30. Similarly, fold line 58 may be foreshortened and fold line 64 and fold line 66 need not intersect fold line 58.

First flap 52 of third member 26 has seventh fold line 70 and eighth fold line 72 running generally parallel to fifth fold line 64 and generally segmenting first front wall flap 52 into innermost segment 74, central segment 76 and outermost segment 78. Outermost segment 78 can be designated as a first flap tab of third member 26.

Second flap 54 of third member 26 similarly has ninth fold line 80 and tenth fold line 82 running generally parallel to sixth fold line 66 and segmenting second flap 54 into innermost segment 84, central segment 86 and outermost segment 88. Outermost segment 88 can be designated as a second flap tab of the third member 26.

Second member 24 has eleventh fold line 90 parallel to first fold line 30 and second fold 58. Fold line 90 bisects second member 24.

First flap 28 of first member 22 has glue line 92 running along the bottom edge 36. The area of glue line 92 is indicated by the area beneath the dashed line and lies beneath the surface of first flap 28 shown in FIG. 1. Second flap 29 has glue line 94 running along the back of bottom edge 42 and along side edge 44. The area of glue line 94 is shown by the area within the dashed line and is below the surface of second flap 29 shown in FIG. 1. In other words, glue lines 92 and 94 are not visible in FIG. 1 but are on the underside of the surface of the blank 20 shown in FIG. 1.

The top surface of first flap tab 78 is covered with glue line 96 shown as a double hatched area. The top surface of second flap tab 88 is covered with glue line 98 also shown as a double hatched area.

Each of the fold lines described above may be score lines which partially cut or coin the paperboard stock to create the fold lines as is known in the paperboard container industry.

Figure 2:
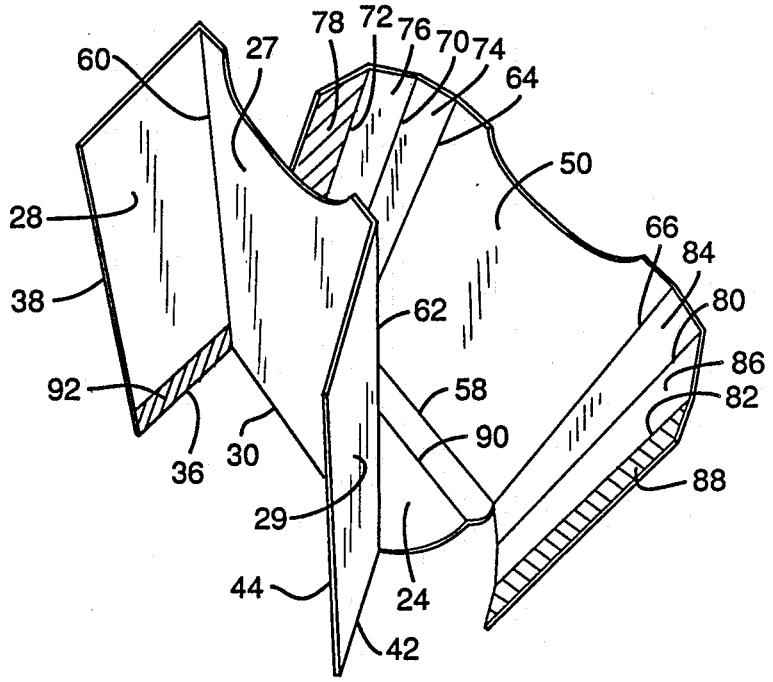
FIG. 2 is a perspective view of the blank partially folded into a container.

Referring now to FIG. 2, the assembly of the container will be explained. First flap 28 of first member 22 is folded behind central portion 27 of first member 22. Glue line 92, shown in this figure as a hatched area, adheres bottom 36 of first flap 28 to the bottom of central portion 27 along fold line 30. Second flap 29 is then folded behind central portion 27 of back wall 22. Second flap 29 overlaps first flap 28 such that outside edge 44 of second flap 29 overlaps edge 38 of first flap 28. Glue line 94 (hidden in FIG. 2) adheres bottom edge 42 of second flap 29 to the bottom of the central portion 27 along fold line 30. Since second flap 29 partially overlaps first flap 28, glue line 94 also adheres second flap 29 along edge 44 to first flap 28 along edge 38. This subassembly forms a fluid tight container receptacle between the combination of first flap 28, second flap 29 and central portion 27 of first member 22.

Second member 24 is folded up against central portion 27 of first member 22 along fold line 30. Second member 24 is then folded down along fold line 90 and then up along fold line 58 such that fold line 58 lies coincidental along fold line 30 and central portion 50 of third member 26 lies atop central portion 27 of first member 22.

Figure 3:
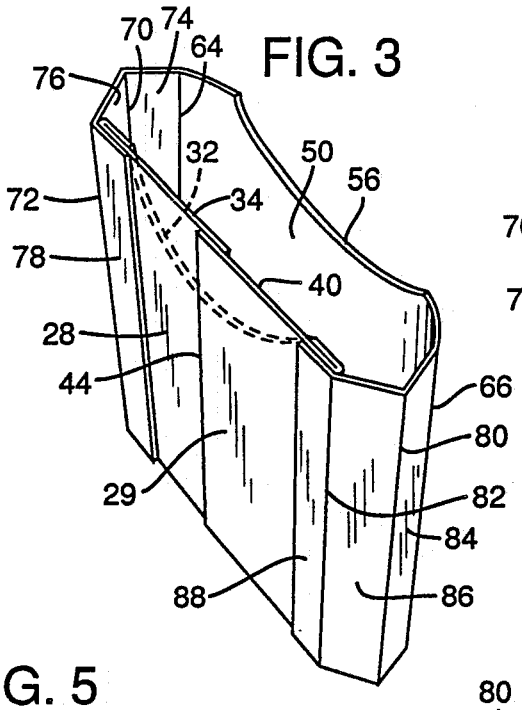
FIG. 3 is a perspective view of the assembled container.

First flap 52 is folded upon fold lines 64, 70 and 72 such that first flap tab 78 is folded behind first flap 28 as may be seen in FIG. 3. Glue line 96, shown in FIG. 2 as a hatched surface lying on tab 78, adheres first flap tab 78 to first flap 28 such that fold line 72 lies along fold line 60.

Second flap 54 is folded upon fold lines 66, 80 and 82 such that second flap tab 88 is folded behind second flap 29. Glue line 98, shown in FIG. 2 as a hatched surface lying on tab 88, adheres second flap tab 88 to second flap 29 such that fold line 82 lies along fold line 62.

FIG. 3 shows a completed assembly with the thickness of the paperboard stock exaggerated to show the overlapping relationship of the various components.

Figure 4:
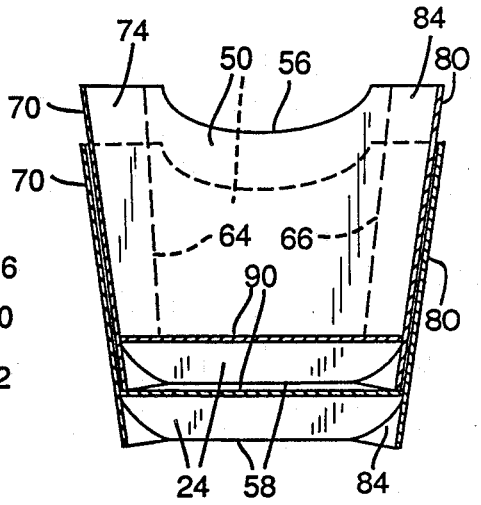
FIG. 4 is a vertical cross section of containers of FIG. 3 arranged in nested relation.

The container, when partially or fully open, is capable of being stacked together in a nesting relationship as shown in FIG. 4.

Figure 5:
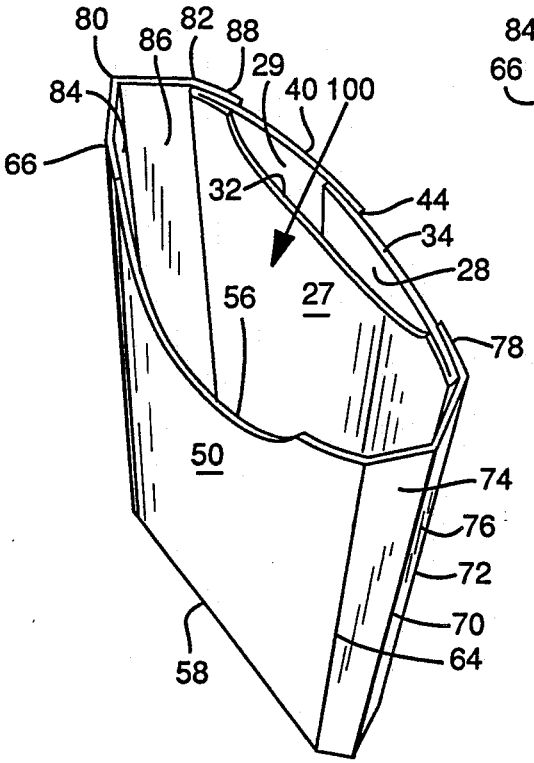
FIG. 5 is a perspective view of the container with the condiment containing receptacle closed. .
Figure 6:
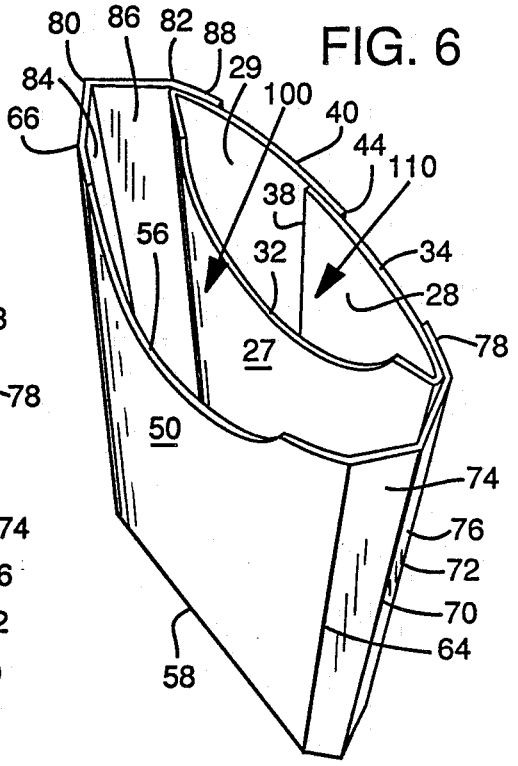
FIG. 6 is a perspective view of the container with the condiment containing receptacle open.

The container may also be used as a scoop for filling the receptacle 100 with food products a shown in FIG. 5. The condiment receptacle 110 shown in FIG. 6 when collapsed as shown in FIG. 5 would not interfere with scooping up the food product into the food container receptacle 100. The condiment receptacle 110 may be opened by raising surfaces 32 and 28 and 29 as shown in FIG. 6. Food container receptacle 100 is bounded by a front wall which is the central portion 50 of third member 26, a back wall which is the central portion 27 of the first member 22, a bottom which is second member 24, a first side which is innermost segment 74 and central segment 76 of first flap 52 of third member 26, and a second side which is innermost segment 84 and central segment 86 of second flap 54 of third member 26.

Condiment container receptacle 110 has only a front wall which is the central portion 27 of first member 22 and a back wall which is the combination of first flap 28 and second flap 29 of first member 22. Condiment container receptacle 110 is therefore adjacent to food container receptacle 100 and shares a common wall which is central portion 27 of first member 22.

Having illustrated and described the principles of the invention in a preferred embodiment, it should be apparent to those skilled in the art that the invention can be modified in arrangement and detail without departing from such principles. I claim all modifications coming within the spirit and scope of the following claims.

I claim:

1. A container formed from a one piece paperboard blank:

the blank having a first member, a second member, and a third member;

the first member having a central portion with a top edge, a bottom edge, and a first flap and a second flap;

the bottom edge of the central portion of the first member attached to the second member;

the first member of the blank having the first flap attached to a first side of the first member and the second flap attached to a second side of the first member;

the third member having a central portion and a top edge, a bottom edge, and a first flap having a tap and a second flap having a tab;

the bottom edge of the central portion of the third member attached to the second member;

the first flap of the first member being folded behind the first member and glued to the bottom of the central portion of the first member;

the second flap of the first member being folded behind the first member and glued to the bottom of the central portion of the first member and to the first flap of the first member;

the second member being folded to bring the central portion of the third member coincidental to the central portion of the first member;

the first flap tab of the third member portion being folded behind the first flap of the first member and glued to the first flap of the first member;

the second flap tab of the third member being folded behind the second flap of the first member and glued to the second flap of the first member;

the central portion of the third member, the central portion of the first member and the second member forming a container receptacle for food; and the central portion of the first member and the first and second flaps of the first member forming a container receptacle for containing condiments.

2. A container comprising:

a one piece paperboard blank folded to form a first open top receptacle having a front, a back having a bottom edge, a first side, a second side and a bottom for receiving a food product;

a second receptacle adjacent to the first receptacle, said second receptacle bounded by a back wall having a bottom edge, and a front wall formed by the back of the first receptacle, the bottom edge of the back wall of said second receptacle sealed to said bottom edge of the back of the first receptacle to form the second receptacle as a fluid tight receptacle for condiments.

3. A one piece blank cut and scored for a paperboard container, said blank comprising:

a first member hinged to a second member along a first fold line;

a third member hinged to the second member along a second fold line;

the second fold line parallel to the first fold line;

the first member having a central portion hinged to a first flap along a third fold line, the third fold line intersecting the first fold line;

the central portion of the first member hinged to a second flap along a fourth fold line, the fourth fold line intersecting the first fold line;

the third member having a central portion hinged to a first flap along a fifth fold line, the fifth fold line intersecting the second fold line;

the central portion of the third member hinged to a second flap along a sixth fold line, the sixth fold line intersecting the second fold line;

the first flap of the third member having a seventh and an eighth fold line segmenting the first flap of the third member into three segments, an outermost segment forming a first flap tab;

the seventh and eighth fold line generally parallel to the fifth fold line;

the second flap of the third member having a ninth and a tenth fold line segmenting the second flap of the third member into three segments, an outer most segment forming a second flap tab;

the ninth and tenth fold line generally parallel to the sixth fold line; and the second member having an eleventh fold line centrally located across the second member parallel to the first and second fold line.

4. A method of producing a container having two container receptacles comprising the steps of:

(a) cutting a one piece blank from rectangular paperboard stock;

(i) the blank having a first member having a central portion with a top edge, a bottom edge, a first side and a second side;

(ii) a first flap of the first member having a top edge, a bottom edge, an outside edge, and an inside edge, the inside edge hinged to the first side of the central portion of the first member;

(iii) a second flap of the first member having a top edge, a bottom edge, an outside edge and an inside edge, the inside edge hinged to the second edge of the central portion of the first member;

(iv) the bottom edge of the first member hinged to a second member;

(v) a third member of the blank having a central portion with a top edge, a bottom edge, a first side and a second side;

(vi) the bottom edge of the third member hinged to the second member;

(vii) a first flap of the third member having a top edge, a bottom edge, an outside edge and an inside edge, the inside edge hinged to the first side of the third member;

(viii) a second flap of the third member having a top edge, a bottom edge, an outside edge and an inside edge, the inside edge being hinged to the second side of the third member;

(b) folding the first flap of the first member behind the central portion of the first member;

(c) gluing the bottom edge of the first flap of the first member to the bottom of the central portion of the first member;

(d) folding the second flap of the first member behind the central portion of the first member, partially overlapping the first flap of the first member;

(e) gluing the bottom edge of the second flap of the first member to the bottom of the central portion of the first member;

(f) gluing the second flap of the first member to the first flap of the first member where the second flap of the first member overlaps the first flap of the first member;

(g) folding the second member up, over the first member;

(h) folding the second member down along a centerline of the second member;

(i) folding the third member up along the intersection of the second member such that the central portion of the third member overlies the central portion of the first member;

(j) folding the first flap of the third member behind the first flap of the first member such that the outside edge of the first flap of the third member overlaps a portion of the inside edge of the first flap of the first member;

(k) gluing the outside edge of the first flap of the third member to the inside edge of the first flap of the third member;

(l) folding the second flap of the third member behind the second flap of the first member such that the outside edge of the second flap of the third member overlaps a portion of the second flap of the first member; and (m) gluing the outside edge of the second flap of the third member to the inside edge of the second flap of the first member.

* * * * *